US010697633B2

(12) United States Patent
Businaro et al.

(10) Patent No.: US 10,697,633 B2
(45) Date of Patent: Jun. 30, 2020

(54) CONTROL SYSTEM FOR CONTROLLING THE PILOT FLAME OF A COMBUSTIBLE GAS DEVICE

(71) Applicant: SIT S.p.A., Padua (IT)

(72) Inventors: Daniele Businaro, Pernumina (IT); Renzo Marcanzin, Mestre (IT); Marco Croin, Lusiana (IT); Daniele Simioni, Borgoricco (IT); Nicola Lollo, Padua (IT); Michele Ciscato, Charlotte, NC (US); James Kupsh, Charlotte, NC (US)

(73) Assignee: SIT S.P.A., Padua (IT)

( * ) Notice: Subject to any disclaimer, the term of this patent is extended or adjusted under 35 U.S.C. 154(b) by 26 days.

(21) Appl. No.: 15/945,251

(22) Filed: Apr. 4, 2018

(65) Prior Publication Data

US 2019/0271466 A1 Sep. 5, 2019

(30) Foreign Application Priority Data

Mar. 5, 2018 (IT) ..... 102018000003291

(51) Int. Cl.
*F23N 5/20* (2006.01)
*F23N 1/00* (2006.01)
(Continued)

(52) U.S. Cl.
CPC ..... *F23N 1/005* (2013.01); *F23N 1/002* (2013.01); *F23N 5/102* (2013.01); *F23N 5/105* (2013.01); *F23N 5/16* (2013.01); *F23N 5/203* (2013.01); *F23N 5/206* (2013.01); *F23N 2223/22* (2020.01); *F23N 2225/12* (2020.01);
(Continued)

(58) Field of Classification Search
CPC ..... F23N 1/005; F23N 5/105
See application file for complete search history.

(56) References Cited

U.S. PATENT DOCUMENTS 2,748,250 A * 5/1956 Andrus ..... F24D 19/0092 204/196.02
2011/0151387 A1* 6/2011 Greene ..... F23N 5/12 431/66
2013/0314226 A1* 11/2013 Zhang ..... G08B 21/24 340/539.11

FOREIGN PATENT DOCUMENTS

JP S5630536 A 3/1981
JP 2000171033 A 6/2000
JP 2011149594 A 8/2011

OTHER PUBLICATIONS

Tanaka (JP2011149594) English translation.*

* cited by examiner

*Primary Examiner* — Jason Lau
(74) *Attorney, Agent, or Firm* — Volpe and Koenig, P.C.

(57) ABSTRACT

Control system for controlling the pilot flame of a combustible gas device, which includes a pilot burner, a main burner, and a valve assembly, which includes a pilot valve that allows/intercepts a flow of gas directed towards the pilot burner, and a main valve that allows/intercepts a gas flow to the main burner, the valve assembly moveable between a closed OFF state, a PILOT state, and an ON state, where gas flows to the main burner. The control system includes a detection device that generates a state signal, and a control unit including a timer, the control unit is operatively connected to the detection device to receive a state signal and to an actuator to close the valve. The control unit starts the timer when the state signal represents the PILOT state, and actuates the actuator for the pilot valve to close it when the timer reaches a preset limit.

14 Claims, 2 Drawing Sheets

(51) Int. Cl.
*F23N 5/10* (2006.01)
*F23N 5/16* (2006.01)

(52) U.S. Cl.
CPC ..... *F23N 2227/02* (2020.01); *F23N 2227/24* (2020.01); *F23N 2241/06* (2020.01)

CONTROL SYSTEM FOR CONTROLLING THE PILOT FLAME OF A COMBUSTIBLE GAS DEVICE

FIELD OF THE INVENTION

The present invention relates to a control system for controlling the pilot flame of a combustible gas device, to a valve assembly comprising said control system, to a combustible gas device comprising said control system, and to a method for controlling the pilot flame of the above-mentioned combustible gas device.

The system according to the invention is used, in particular although not exclusively, in the technical field of apparatuses for operating the pilot flame of combustible gas heating equipment, in particular devices for heating environments/circulating water in heating systems.

In particular, the invention relates to combustible gas devices that comprise a pilot burner for generating a pilot flame and a main burner for generating a main flame, in which combustion is initiated in the main burner by means of the pilot flame.

BACKGROUND

Combustible gas devices comprising a pilot burner typically keep the pilot flame lit from when the device itself is switched on, until it is turned off. This involves a high consumption of gas.

In order to limit the amount of gas that such devices consume, gas regulation systems are known, which act on the pilot burner in order to extinguish the pilot flame when the main burner is turned off. US patent application 2007/0275334 A1 describes one example of the above-mentioned gas-regulation system. In particular, the regulation system described in US 2007/0275334 A1 provides the use of a temperature sensor positioned near to the main flame produced by the main burner of a gas system and of a control unit connected to a valve apparatus arranged upstream of the pilot burner with regard to the direction of flow of a flow of gas directed towards said burner. The temperature sensor is electrically connected to the control unit so as to actuate said valve apparatus in order to block the gas directed towards the pilot burner when a specific condition occurs, i.e. the decrease in the temperature detected by the temperature sensor as a result of the main burner being turned off.

The regulation system described in US 2007/0275334 A1 is, however, susceptible to several drawbacks. These drawbacks may be identified as the increase in the structural complexity of the gas device as a result of the temperature sensor being in the vicinity of the main burner, and as the need to provide a temperature sensor that can resist very high temperatures and is therefore relatively expensive.

The object of the present invention is to provide a control system for controlling the pilot flame of a combustible gas device, a valve assembly comprising said control system, a combustible gas device comprising said control system, and a method for controlling the pilot flame of said combustible gas device, which overcome at least one of the disadvantages of the identified prior art.

SUMMARY

This object is achieved by means of a control system for controlling the pilot flame of a combustible gas device, a valve assembly comprising said control system, a combustible gas device comprising said control system, and a method for controlling the pilot flame of said combustible gas device in accordance with the respective independent claims appended to the present description.

Preferred features of the invention are defined in the dependent claims.

According to a first aspect of the invention, the gas device comprises a pilot burner for generating a pilot flame, a main burner for generating a main flame, and a valve assembly. The gas device can be associated with a system for heating environments.

The valve assembly comprises a pilot valve that is arranged upstream of the pilot burner in order to allow/intercept a flow of gas directed towards the pilot burner, and a main valve that is arranged upstream of the main burner (and in particular downstream of the pilot valve) in order to allow/intercept a flow of gas directed towards the main burner.

According to one aspect of the invention, the pilot valve and the main valve are associated with respective actuators for opening/closing said valves.

The state of the valve assembly can be moved between an OFF state, a PILOT state and an ON state. The control system according to the invention may comprise a setting device adapted to set the valve assembly to the OFF, PILOT and ON states, as will be clearly explained in the following.

In particular, in the OFF state, the pilot valve and the main valve are both closed, whilst in the PILOT state, the pilot valve is open and stays open as a result of the pilot flame, while the main valve remains disabled to allow gas to flow towards the main burner. In the ON state, the pilot valve is open and the main valve is enabled to allow gas to flow towards the main burner.

Within the context of the present invention, the main valve may be regarded as disabled if placed in a condition in which it cannot be controlled and/or actuated and/or forced to open/close, thus maintaining an idle configuration over time. The idle configuration is preferably identified by the main valve being closed in order to intercept a flow of gas directed towards the main burner and to prevent said flow from reaching said main burner. When the main valve is disabled, the main flame is therefore extinguished.

In contrast, the main valve may considered to be "enabled" if it is placed in a condition in which it can be controlled and/or actuated and/or forced to open/close, for example on the basis of the operating conditions of the gas device, as will be explained in more detail in the following.

According to one aspect of the invention, when the valve assembly is in the OFF state, the pilot flame and the main flame are extinguished, whilst in the PILOT state, the pilot flame is lit and the main flame is extinguished. When the valve assembly is in the ON state, the pilot flame is lit and the main flame can be lit or extinguished depending on the operating conditions of the gas device, for example whether or not heat needs to be supplied.

The main valve is preferably a servo-assisted valve, i.e. it is associated with a solenoid valve for controlling a servo-assistance circuit that forces the main valve open when the solenoid valve is energized, i.e. when the actuator for the solenoid valve is energized by a supply signal through an electrical supply circuit. In particular, energizing the actuator for the solenoid valve corresponds to the excitation of a solenoid of the actuator itself by means of the supply signal.

According to one aspect of the invention, a thermopile is arranged next to the pilot burner so as to be energized by the pilot flame. The thermopile generates said supply signal when it is energized by the pilot flame.

In particular, the solenoid valve of the main valve is electrically connected to the thermopile by means of the electrical supply circuit.

The generation of a voltage signal by the thermopile, i.e. the generation of the supply signal, preferably places the main valve in the condition in which it is enabled. Alternatively, the main valve can be considered to be disabled.

In particular, the main valve comprises a seat and a shutter that is associated with said seat for intercepting a flow of gas directed towards the main burner, the shutter being forced to open the seat by the solenoid valve, and to close it by means of a spring. The actuator for the main valve can therefore comprise the servo-assistance circuit mentioned above.

According to one aspect of the invention, the main valve can be considered to be enabled if the electrical supply circuit of the actuator for said valve is supplied with power by the above-mentioned supply signal. In contrast, the main valve can be considered to be disabled if said electrical supply circuit is not supplied with power by the above-mentioned supply signal.

The pilot valve comprises a particular seat and a particular shutter that acts on said seat for intercepting a flow of gas directed towards the pilot burner.

According to one aspect of the invention, the pilot valve is associated with a magnetic assembly with a start-up system, preferably a manual start-up system. The shutter of the pilot valve is held in the position of opening of the particular seat by the excitation of the magnetic assembly that is generated by the voltage correlating to the voltage of a thermoelectric generator, for example a thermocouple, which is associated with the pilot flame of the pilot burner. The shutter of the pilot valve is forced to close the seat by means of a particular spring of the magnetic assembly. The actuator for opening/closing the pilot valve can be identified by the magnetic assembly. The magnetic assembly may comprise the actuator for opening/closing the pilot valve.

In particular, the magnetic assembly can comprise a thermocouple, which is arranged at the pilot burner so as to be energized by the pilot flame, an electromagnet (for example an on-off electromagnet having resilient return) that acts on the shutter of the pilot valve, and an electrical circuit that connects the thermocouple to the electromagnet in order to energise said magnet by means of the thermocouple. The actuator for opening/closing the pilot valve may comprise the electromagnet.

When the pilot flame is extinguished, the magnetic assembly is therefore not excited and the pilot valve is consequently closed unless the pilot valve is forced open by the start-up system. In contrast, the pilot flame that is lit excites the magnetic assembly by means of the thermocouple, the voltage generated in said thermocouple holding the pilot valve in the open position when it reaches a sufficiently high value.

According to one aspect of the invention, the start-up system comprises an actuator stem, on which the shutter of the pilot valve is mounted, and a control knob that is rotatably associated with the actuator stem.

The control knob can be rotated about the axis of longitudinal extension of the actuator stem and said stem can axially slide with respect to a casing of the valve assembly. The sliding movement of the actuator stem in a first direction forces the pilot valve open, in contrast to elastic resilient return means, such as a spring, which forces the shutter of the pilot valve to close the particular seat.

The control knob makes it possible to set the valve assembly in the OFF, PILOT and ON state. In particular, the control knob can rotate so as to be positionable in three different preset angular positions. The setting device of the control system can therefore be identified by said control knob.

In the first angular position, referred to as the OFF position, the elastic return means associated with the shutter of the pilot valve holds said valve in the closed position, and the magnetic assembly is consequently not excited (as a result of there being no flame at the thermocouple).

In the second angular position, referred to as the PILOT position, the control knob can be pressed so as to axially move the actuator stem. The movement of the actuator stem causes the pilot valve to open, which allows a flow of gas to reach the pilot burner. The pilot flame generated by the pilot burner, for example by means of a piezoelectric igniter, therefore supplies the thermocouple with power, which in turn excites the magnetic assembly, thereby holding the shutter of the pilot valve in the open position. In the second angular position, in particular before the pilot flame is generated by the pilot burner, the main valve is disabled.

In the third angular position, referred to as the ON position, the pilot valve is held open by the magnetic assembly excited by the thermocouple, while the main valve is enabled.

According to one aspect of the invention, the control system comprises a detection device which is adapted to detect at least the PILOT state, more preferably for detecting the PILOT and ON states of the valve assembly, and for generating a state signal that represents the detected state of the valve assembly.

Furthermore, the control system according to the invention comprises a control unit that is operatively connected to the detection device in order to receive the state signal and to the actuator for the pilot valve in order to close said valve.

According to one aspect of the invention, the detection device comprises a Hall Effect sensor, which is associated with the control knob of the start-up system in order to generate an output signal that represents the PILOT state and, preferably, the ON state of the valve assembly. The Hall Effect sensor is preferably electrically connected to the control unit, which is configured to activate said sensor and to receive the output signal generated by this sensor.

When the control knob is in the OFF position, the Hall Effect sensor is not active, whereas, in the PILOT and ON positions, said sensor is activated by the control unit. In particular, a magnetic element (magnet) is integral with the control knob, whereas the Hall Effect sensor is coupled to a body made of ferromagnetic material, which is arranged in the vicinity of the control knob in order to provide a voltage signal in response to the effect of the magnetic field, produced by said magnet, on the Hall Effect sensor. The rotation of the control knob determines the angular displacement of the magnetic element with respect to the body made of ferromagnetic material, which consequently changes the voltage signal supplied by the Hall Effect sensor.

According to one aspect of the invention, the magnetic element is placed in the PILOT position of the control knob. The Hall Effect sensor is preferably substantially superimposed on the magnetic element when the control knob is in the PILOT position.

According to one aspect of the invention, the control unit comprises a timer.

According to one aspect of the invention, the control unit is configured to start the timer when the state signal received by the detection device represents the PILOT state, and to actuate the actuator for the pilot valve in order to close said valve when the time measured by the timer reaches a preset limit, thereby extinguishing the pilot flame.

The control unit preferably comprises a first switch device, which is arranged in the electrical circuit that connects the thermocouple to the electromagnet of the magnetic assembly for opening said electrical circuit when the time measured by the timer reaches the preset limit. In other words, the control unit comprises a first switch device arranged in the electrical circuit, which connects the thermocouple to the actuator for the pilot valve. Opening the first switch device switches off the power supply to the actuator for the pilot valve, thereby closing said valve.

These features therefore allow the pilot flame to be extinguished after the valve assembly has been in the PILOT state for a certain amount of time, thereby stopping the gas device from consuming gas.

The preset limit is preferably between 1 and 10 days.

According to one aspect of the invention, the detection device is also adapted to detect the ON state of the valve assembly and to generate a state signal that represents the detected state of the valve assembly.

The control unit can be configured to stop the timer and to reset the time measured by said timer when the state signal received by the detection device represents the ON state.

These features are especially useful for a first embodiment of the invention, in which the main valve is always open in order to allow a flow of gas directed towards the main burner in order to light the main flame or keep it lit when the valve assembly is in the ON state. The main valve is therefore closed when the valve assembly state is moved from the ON state to the PILOT state or the OFF state, thereby resulting in the main flame being extinguished.

This embodiment can be associated with the manual operation of a heating system using the gas device.

In a second embodiment of the invention, the control system comprises a thermostat that is operatively connected to the control unit, the thermostat comprising a temperature sensor for detecting an ambient temperature, which is the temperature of the environment around the thermostat. In this case, the control unit is configured to start the timer when the state signal received by the detection device represents the ON state and when the ambient temperature detected by the temperature sensor is greater than, or equal to, a preset threshold value.

The timer is therefore only started once the ambient temperature detected by the temperature sensor is lower than said threshold value.

According to one aspect of the invention, the thermostat is operatively connected to the actuator for the main valve in order to open and close it on the basis of the temperature detected by the temperature sensor.

In other words, the thermostat is operatively connected to the actuator for the main valve in order to actuate the actuator for the main valve such that said valve is closed when the ambient temperature detected by the temperature sensor is greater than, or equal to, the preset threshold value, thereby extinguishing the main flame.

In particular, the thermostat is connected to the supply circuit of the actuator for the main valve by means of a second switch device that is opened/closed by a signal coming from the temperature sensor: if the ambient temperature detected by the temperature sensor is greater than, or equal to, the preset threshold value, the second switch device is open, whereas, if the ambient temperature detected by the temperature sensor is lower than the preset threshold value, the second switch device is closed.

When the second switch device is open, the solenoid valve is not energized and the main valve is therefore closed. In this way, the flow of gas is prevented from reaching the main burner, thereby extinguishing the main flame.

In contrast, i.e. when the second switch is closed, the main valve is open since the solenoid valve is energized by the supply signal. In this way, a flow of gas can reach the main burner in order to generate the main flame.

The thermostat preferably comprises the second switch device in addition to the temperature sensor.

According to one aspect of the invention, the control unit is electrically connected to the second valve device (preferably by means of the electrical supply circuit) so as to start the timer when the state signal received by the detection device represents the ON state and when the second switch device is open.

When the valve assembly is in the ON state and the temperature detected by the temperature sensor is greater than or equal to, the preset threshold value, the main valve is therefore closed and the timer is started. If the time measured by the timer reaches the preset limit, the pilot valve will be closed.

According to one aspect of the invention, the control unit is configured to stop and reset the timer when the state signal received by the detection device represents the ON state and when the ambient temperature detected by the temperature sensor is lower than the preset threshold value. It must be noted that, in this condition, the main flame is lit and the timer therefore does not need to be started, but it is useful to return said timer to an initial condition in order to measure the time at a later point.

According to one aspect of the invention, the control unit is supplied with power by means of a thermopile that is arranged next to the pilot burner so as to be energized by the pilot flame. Alternatively, the control unit is supplied with power by means of a battery.

When the control unit is supplied with power, it activates the Hall effect sensor.

According to one aspect of the invention, the control system comprises an indicator, preferably an acoustic and/or visual indicator, which is operatively connected to the control unit in order to emit a warning signal when the supply voltage for the control unit reaches a preset condition, that is, it reaches a preset value that ensures that the control unit is working properly.

This feature is particularly useful if the control unit is supplied with power by the thermopile. In fact, the voltage generated by the thermopile reaches a regular voltage that allows the control unit to work properly, usually after a transition period from when the pilot flame is lit.

It must be noted that the valve assembly and/or the gas device may comprise the control system according to one or more of the features described above.

According to one aspect of the invention, a method for controlling the pilot flame of a combustible gas device comprises the steps of:

detecting the state of the valve assembly, activating a timer if the detected state of said valve assembly is the PILOT state, and closing the pilot valve when the time measured by the timer reaches a preset limit, thereby extinguishing the pilot flame.

According to one aspect of the invention, the above-mentioned method also comprises the steps of:

detecting the ambient temperature by means of a temperature sensor of a thermostat, activating the timer if the detected state of the valve assembly is the ON state and if the ambient temperature detected is greater than, or equal to, a preset threshold value, and closing the pilot valve when the time measured by the timer reaches a preset limit.

The method for controlling the pilot flame of a combustible gas device may comprise the step of stopping the timer and resetting the time measured thereby if the state signal detected is the ON state signal.

Alternatively, the timer can be stopped and the time measured thereby can be reset if the state signal detected is the ON state signal and if the ambient temperature detected by the temperature sensor is lower than the preset threshold value.

BRIEF DESCRIPTION OF THE DRAWINGS

Additional features and advantages of the invention will become clearer from the following detailed description of a preferred embodiment thereof, which is illustrated by way of non-restrictive example, with reference to the accompanying figures, in which.

DETAILED DESCRIPTION OF THE PREFERRED EMBODIMENTS

Figure 1:
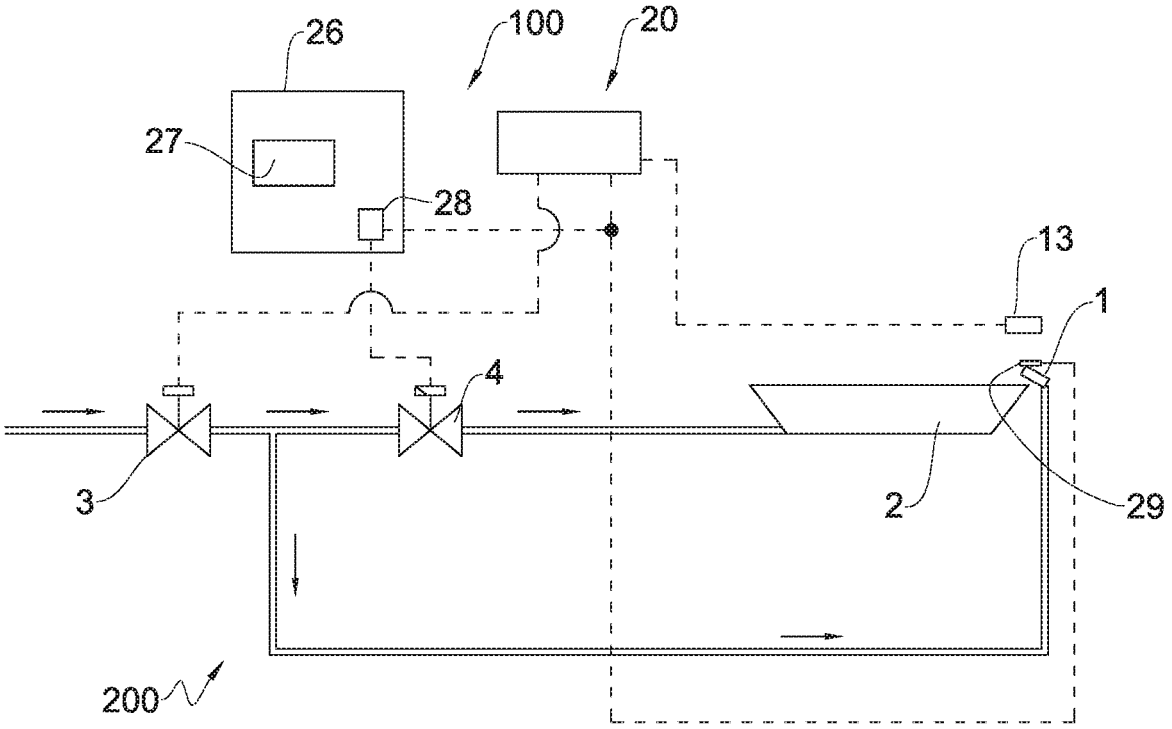
FIGS. 1 and 2 are schematic views of a gas device comprising a control system according to the invention.
Figure 2:
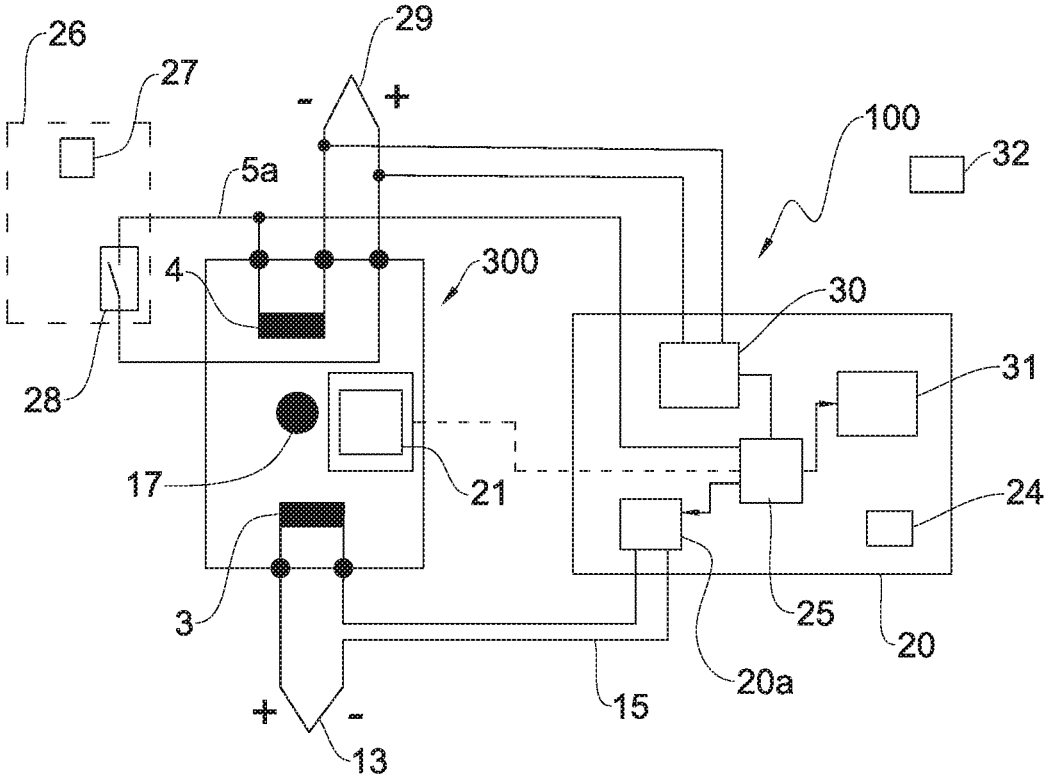

With reference to FIGS. 1 and 2, reference numeral 100 indicates a control system for controlling the pilot flame of a combustible gas device 200 as a whole.

The gas device 200 comprises a pilot burner 1 for generating a pilot flame, a main burner 2 for generating a main flame, and a valve assembly 300.

The valve assembly 300 comprises a pilot valve 3 that is arranged upstream of the pilot burner 1 in order to allow/intercept a flow of gas directed towards the pilot burner 1, and a main valve 4 that is arranged upstream of the main burner 2 in order to allow/intercept a flow of gas directed towards the main burner 2. The pilot valve and the main valve are associated with respective actuators 10, 4*a* for opening/closing said valves.

The state of the valve assembly 300 can be moved between an OFF state, a PILOT state and an ON state. In the OFF state, the pilot valve 3 and the main valve 4 are both closed, whilst, in the PILOT state, the pilot valve 3 is open and the main valve 4 is disabled to allow gas to flow towards the main burner 2. In the ON state, the pilot valve 3 is open and the main valve 4 is enabled to allow gas to flow towards the main burner 2.

Figure 3:
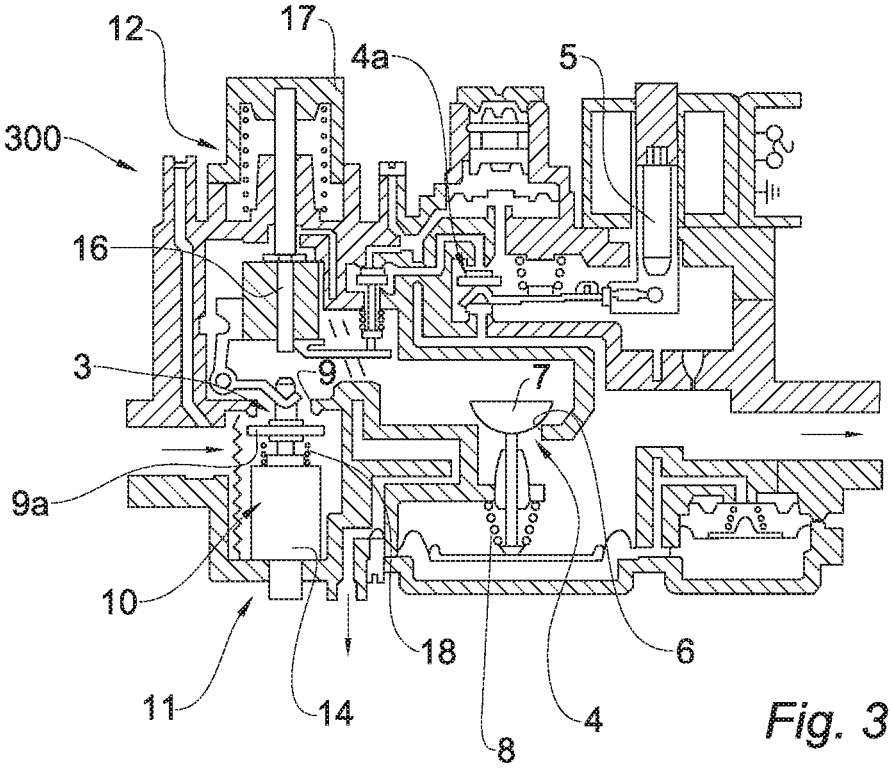
FIG. 3 is a schematic view of a valve assembly according to the invention.

With reference to FIG. 3, the main valve 4 is a servo-assisted valve, i.e. it is associated with a solenoid valve 5 for controlling a servo-assistance circuit that forces the main valve 4 open when the solenoid valve 5 is energized by means of a thermopile 29, i.e. when the actuator for the solenoid valve 5 is energized by a supply signal through an electrical supply circuit 5*a*. The supply signal coming from a thermopile 29 that is supplied with power by the pilot flame.

The actuator 4*a* for opening/closing the main valve 4 therefore comprises the servo-assistance circuit mentioned above.

The main valve 4 comprises a seat 6 and a shutter 7 associated with said seat 6 for intercepting a flow of gas directed towards the main burner 2, in which the shutter 7 is forced to open the seat 6 by means of the solenoid valve 5 and is forced to close the seat by means of a spring 8.

The pilot valve 3 comprises a particular seat 9 and a particular shutter 9*a* that is active on said seat 9 in order to intercept a flow of gas directed towards the pilot burner 1.

The pilot valve 3 is associated with a magnetic assembly 11 with a start-up system 12 that is preferably a manual start-up system. The actuator 10 for the pilot valve 3 for opening/closing the pilot valve 3 can be identified by the magnetic assembly 11. The magnetic assembly 11 may comprise the actuator 10.

The magnetic assembly 11 comprises a thermocouple 13 arranged at the pilot burner 1 so as to be energized by the pilot flame, a electromagnet 14 (preferably a manual start-up electromagnet 14) and an electrical circuit 15 that connects the thermocouple 13 to the electromagnet 14. The electromagnet 14 is energized by the thermocouple 13. The actuator 10 may comprise the electromagnet 14.

In this way, the pilot flame that is lit excites the magnetic assembly 11 by means of the thermocouple 13, the voltage generated by said thermocouple opening and holding the pilot valve 3 in the open position when it reaches a sufficiently high value.

With reference to FIG. 3, the start-up system 12 comprises an actuator stem 16 and a control knob 17 that is rotatably associated with the actuator stem 16. The control knob 17 can rotate about the longitudinal axis of the actuator stem 16 and can be subjected to pressure along said axis, causing the actuator stem 16 to slide, which thereby forces the pilot valve 3 open, in contrast to a spring 18 that forces the shutter 9*a* to close the particular seat 9.

The control knob 17 makes it possible to set the valve assembly to the OFF, PILOT and ON state by being rotatable and positionable in three separate preset angular positions, which are respectively referred to as OFF, PILOT and ON.

In the OFF position, the spring 18 holds the pilot valve 3 in the closed position and the magnetic assembly 11 is consequently not excited as a result of there being no flame at the thermocouple 13.

In the PILOT position, the control knob 17 can be pushed, thereby opening the pilot valve 3 which allows a flow of gas to reach the pilot burner 1. The pilot flame generated by the pilot burner 1 supplies the thermocouple 13 which power, which in turn excites the magnetic assembly 11, thereby holding the shutter 9*a* in the open position. In the PILOT position, the main valve 4 is disabled, in particular before the pilot flame is generated by the pilot burner.

In the ON position, the pilot valve 3 is held open by the magnetic assembly 11 that is excited by the thermocouple 13, whilst the main valve 4 is enabled.

The control system 100 comprises a detection device 19 which is adapted to detect at least the PILOT state, more preferably to detect the PILOT and the ON state of the valve assembly 300, and to generate a state signal that represents the detected state of the valve assembly.

The control system 100 also comprises a control unit 20 that is operatively connected to the detection device 19 in order to receive the state signal, and to the actuator 10 for the pilot valve 3 in order to close said valve.

Figure 4:
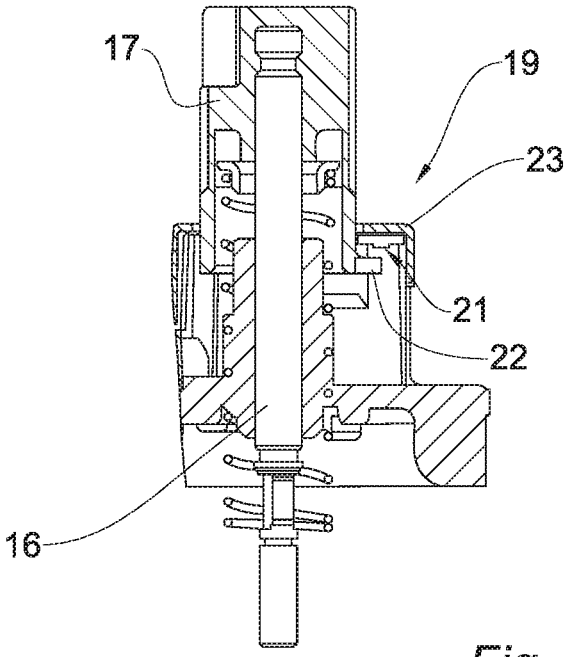
FIG. 4 is a sectional view of a detail of a valve assembly according to the invention.

With reference to FIG. 4, the detection device 19 comprises a Hall Effect sensor 21 that is associated with the control knob 17 in order to generate an output signal that represents the PILOT state, and preferably the ON state, of the valve assembly 200. In particular, the Hall Effect sensor 21 is electrically connected to the control unit 20 which is configured to activate said sensor and to receive the output signal generated thereby.

When the control knob 17 is in the OFF position, the Hall effect sensor 21 is not active, whereas, in the PILOT and ON positions, said sensor is started by the control unit 20.

Still with reference to FIG. 4, a magnetic element (magnet) 22 is integral with the control knob 17, whilst the Hall Effect sensor 21 is preferably coupled to a body 23 made of ferromagnetic material that is arranged in the vicinity of the control knob 17 in order to supply a voltage signal in response to the effect of the magnetic field, produced by the magnet 22, on the Hall Effect sensor 21 23.

The rotation of the control knob 17 determines the angular displacement of the magnetic element 22 with respect to the body 23 made of ferromagnetic material, which consequently changes the voltage signal supplied by the Hall Effect sensor 21.

The magnetic element 22 is arranged in the PILOT position of the control knob.

The control unit 20 comprises a timer 24. In particular, the timer is formed as a code of a program stored in a storage unit of the control unit 20.

In particular, the storage unit is arranged in a microcontroller 25 of the control unit 20.

The control unit 20 is configured to start the timer 24 when the state signal received by the detection device 19 represents the PILOT state, and to actuate the actuator 10 for the pilot valve 3 in order to close said valve when the time measured by the timer 24 reaches a preset limit, thereby extinguishing the pilot flame.

In particular, the control unit 20 comprises a first switch device 20*a*, which is arranged in the electrical circuit 15 that connects the thermocouple 13 to the electromagnet 14 of the magnetic assembly 11 and for opening said electrical circuit 15 when the time measured by the timer 24 reaches the preset limit.

The preset limit is preferably between 1 and 10 days.

The detection device 19 is also adapted to detect the ON state of the valve assembly 300 and to generate a state signal that represents the detected state of the valve assembly 300. The control unit 20 can be configured to stop the timer 24 and to reset the time measured thereby when the state signal received by the detection device 19 represents the ON state.

This feature is particularly useful in gas devices 200 in which the main valve 1 is always open when the valve assembly 300 is in the ON state. The main valve 1 is therefore closed when the state of the valve assembly 200 moves from the ON state into the PILOT or OFF state, for example by means of the control knob 17.

With reference to FIG. 1 in particular, the control system 100 comprises a thermostat 26 that is operatively connected to the control unit 20, the thermostat 26 comprising a temperature sensor 27 for detecting an ambient temperature, that is the temperature of the environment around the thermostat 26.

In this embodiment of the invention, the control unit 20 is configured to start the timer 24 when the state signal received by the detection device 19 represents the ON state and when the ambient temperature detected by the temperature sensor 27 is greater than, or equal to, a preset threshold value.

It must be noted that the thermostat 26 is operatively connected to the actuator 4*a* for the main valve 4 in order to open and close said valve on the basis of the temperature detected by the temperature sensor 27 (when the valve assembly is in the ON state).

In particular, the thermostat 26 is connected to the supply circuit 5*a* of the actuator 4*a* for the main valve 4 by means of a second switch device 28 that is opened/closed by a signal coming from the temperature sensor 27: if the ambient temperature detected by the temperature sensor 27 is greater than, or equal to, the preset threshold value, the second switch device 28 is open, whereas, if the ambient temperature detected by the temperature sensor 27 is less than the preset threshold value, the second switch device 28 is closed.

The thermostat 26 comprises the second switch device 28.

When the second switch device 28 is open, the solenoid valve 5 is not energized and the main valve 4 is therefore closed and prevents the flow of gas reaching the main burner.

When the second switch device 28 is closed, the main valve 5 is open and a flow of gas can therefore reach the main burner in order to generate the main flame.

The control unit 20 can be configured to stop and reset the timer 24 when the state signal received by the detection device 19 represents the ON state and when the ambient temperature detected by the temperature sensor 17 is less than the preset threshold value.

With reference to FIGS. 1 and 2, the control unit 20 is supplied with power by means of the thermopile 29 that is arranged at the pilot burner 1 so as to be energized by the pilot flame. A DC/DC converter 30 is preferably provided between the thermopile 29 and the microcontroller 25.

Alternatively, the control unit 20 can be supplied with power by a battery.

The control system 100 comprises an indicator 31, preferably an acoustic indicator, which is operatively connected to the control unit 20 in order to emit a (brief) warning signal when the supply voltage of the control unit 20 reaches a preset value that ensures that the control unit is working properly.

The invention therefore achieves the objects set and has the advantages mentioned above with respect to the known solutions.

The invention claimed is:

1. Control system for controlling a pilot flame of a combustible gas device, said gas device (200) comprising:

a pilot burner (1) for generating a pilot flame, a main burner (2) for generating a main flame, and a valve assembly (300), comprising a pilot valve (3) that is arranged upstream of said pilot burner (1) in order to allow/intercept a flow of gas directed towards said pilot burner (1), and a main valve (4) that is arranged upstream of said main burner (2) in order to allow/intercept a flow of gas directed towards said main burner (2), wherein the state of said valve assembly (300) can be moved between an OFF state, in which said pilot valve (3) is closed, a PILOT state, in which said pilot valve (3) is open and said main valve (4) is disabled to allow a flow of gas to flow towards said main burner (2), and an ON state, in which said pilot valve (3) is open and said main valve (4) is enabled to allow a flow of gas to flow towards said main burner (2), said control system (100) comprising:

a detection device (19) adapted to detect at least the PILOT state of said valve assembly (300) and to generate a state signal, which represents the detected state of said valve assembly (300), a control unit (20) comprising a timer (24), said control unit (20) being operatively connected to said detection device (19) so as to receive said state signal, and to an actuator (10) for said pilot valve (3) in order to close it, wherein said control unit (20) is configured to:

start said timer (24) when the state signal received by said detection device (19) represents the PILOT state, and actuate said actuator (10) for said pilot valve (3) in order to close said valve when the time measured by said timer (24) reaches a preset limit, thereby extinguishing the pilot flame, wherein said control system (100) comprises a thermostat (26) that is operatively connected to said control unit (20), said thermostat (26) comprising a temperature sensor (27) for detecting an ambient temperature, wherein said detection device (19) is also adapted to detect the ON state of said valve assembly (300) and to generate a state signal that represents the detected state of said valve assembly, said control unit (100) being configured to:

start said timer (24) when the state signal received by said detection device (19) represents the ON state and the ambient temperature detected by said temperature sensor (27) is greater than, or equal to, a preset threshold value, and actuate said actuator (10) for said pilot valve (3) in order to close said valve when the time measured by said timer (24) reaches a preset limit, thereby extinguishing the pilot flame.

2. The control system according to claim 1, wherein said detection device (19) is also adapted to detect the ON state of said valve assembly (300) and to generate a state signal that represents the detected state of the valve assembly (300), said control unit (20) being configured to stop said timer (24) and to reset the time measured by said timer when the state signal received by said detection device (19) represents the ON state.

3. The control system according to claim 1, wherein said control unit (100) is configured to stop and reset said timer (24) when the state signal received by said detection device (19) represents the ON state and the ambient temperature detected by said temperature sensor (27) is lower than said preset threshold value.

4. The control system according to claim 1, wherein said thermostat (26) is operatively connected to an actuator (4*a*) for said main valve (4) in order to actuate said actuator (4*a*) such that said main valve (4) is closed when the ambient temperature detected by said temperature sensor (27) is greater than, or equal to, said preset threshold value, thereby extinguishing the main flame.

5. The control system according to claim 1, wherein said actuator (10) for said pilot valve (10) is part of a magnetic assembly (11) of said valve assembly, said magnetic assembly (11) also comprising a thermocouple (13) that is arranged at the pilot burner (1) so as to be energized by the pilot flame, and an electrical circuit (15) that connects said thermocouple (13) to an electromagnet (14) of said actuator in order to supply it with power, wherein said control unit (100) comprises a first switch device (20*a*), which is arranged between said thermocouple and said electromagnet (14) in said electrical circuit in order to open said electrical circuit when the time measured by said timer (24) reaches a preset limit.

6. The control system according to claim 1, wherein said detection device (19) comprises a Hall effect sensor (21) that is associated with a control knob (17) that can be rotated so as to be positionable in three separate angular positions in order to set said gas device (200) to the OFF, PILOT and ON states.

7. The control system according to claim 1, wherein said control unit is supplied with power by means of a thermopile (29) that is arranged at the pilot burner (1) so as to be energized by the pilot flame.

8. The control system according to claim 7, comprising an indicator (31), which is an acoustic indicator or a visual indicator or both an acoustic and visual indicator and which is operatively connected to said control unit in order to emit a warning signal when the supply voltage for said control unit (100) reaches a preset condition.

9. The control system according to claim 1, wherein said control unit is supplied with power by a battery (32).

10. Valve assembly (300), comprising:

a pilot valve (3) that is arranged upstream of a pilot burner (1) in order to allow/intercept a flow of gas directed towards said pilot burner (1), said pilot burner being adapted to generate a pilot flame, a main valve (4) that is arranged upstream of a main burner (2) in order to allow/intercept a flow of gas directed towards said main burner (2), said main burner being adapted to generate a main flame, and a control system according to claim 1, wherein the state of said valve assembly (300) can be moved between an OFF state, in which said pilot valve (3) is closed, a PILOT state, in which said pilot valve (3) is open and said main valve (4) is disabled to allow gas to flow towards said main burner (2), and an ON state, in which said pilot valve (3) is open and said main valve (4) is enabled to allow gas to flow towards said main burner (2).

11. Combustible gas device (200), comprising:

a pilot burner (1) for generating a pilot flame, a main burner (2) for generating a main flame, and a valve assembly (300), which comprises a pilot valve (3) that is arranged upstream of said pilot burner (1) in order to allow/intercept a flow of gas directed towards said pilot burner (1), and a main valve (4) that is arranged upstream of said main burner (2) in order to allow/intercept a flow of gas directed towards said main burner (2), and a control system according to claim 1, wherein the state of said valve assembly (300) can be moved between an OFF state, in which said pilot valve (3) is closed, a PILOT state, in which said pilot valve (3) is open and said main valve (4) is disabled to allow gas to flow towards said main burner (2), and an ON state, in which said pilot valve (3) is open and said main valve (4) is enabled to allow gas to flow towards said main burner (2).

12. Method for controlling the pilot flame of a combustible gas device, said method comprising the steps of:

detecting the state of said valve assembly between an OFF state, in which a pilot valve (3) of the gas device is closed, a PILOT state, in which said pilot valve (3) is open and a main valve (4) is disabled to allow gas to flow towards a main burner (2), and an ON state, in which said pilot valve (3) is open and said main valve (4) is enabled to allow gas to flow towards said main burner (2), activating a timer (24) if the detected state of said valve assembly is the PILOT state, closing the pilot valve when the time measured by said timer (24) reaches a preset limit, thereby extinguishing the pilot flame;

detecting the ambient temperature by means of a temperature sensor (27) of a thermostat (26), activating the timer if the detected state of said valve assembly is the ON state and the ambient temperature detected is greater than, or equal to, a first preset threshold value, and closing the pilot valve when the time measured by said timer (24) reaches said preset limit.

13. The method according to claim 12, further comprising the step of stopping the timer (24) and resetting the time measured thereby if the state signal detected is the ON state signal.

14. The method according to claim 12, further comprising the step of stopping the timer (24) and resetting the time measured thereby if the state signal detected is the ON state signal and if the ambient temperature detected by the temperature sensor (27) is lower than the preset threshold value.

* * * * *